US009457603B2

(12) United States Patent
Aerts et al.

(10) Patent No.: US 9,457,603 B2
(45) Date of Patent: Oct. 4, 2016

(54) APPARATUS FOR COOLING MEDIA SHEETS

(71) Applicant: OCE-TECHNOLOGIES B.V., Venlo (NL)

(72) Inventors: Wilhelmus J. Aerts, Venlo (NL); Peter G. La Vos, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/939,975

(22) Filed: Nov. 12, 2015

(65) Prior Publication Data

US 2016/0136974 A1 May 19, 2016

(30) Foreign Application Priority Data

Nov. 13, 2014 (EP) ..... 14193048

(51) Int. Cl.

| | |
|---|---|
| ***B41J 29/377*** | (2006.01) |
| ***B41J 13/00*** | (2006.01) |
| ***B41J 3/60*** | (2006.01) |
| ***G03G 15/23*** | (2006.01) |

(52) U.S. Cl.

CPC ..... *B41J 29/377* (2013.01); *B41J 3/60* (2013.01); *B41J 13/009* (2013.01); *G03G 15/235* (2013.01)

(58) Field of Classification Search

CPC .... B41J 29/377; B41J 13/00; B41J 13/0009; B41J 13/0018; B41J 13/0027; B41J 13/0036; B41J 13/0045; B41J 13/103; B41J 13/106; B41J 13/02; B41J 13/14; B41J 13/009; B41J 3/60; G03G 15/235

USPC ..... 347/104

See application file for complete search history.

(56) References Cited

U.S. PATENT DOCUMENTS

| | | | | |
|---|---|---|---|---|
| 5,155,536 | A | 10/1992 | Johnson et al. | |
| 2002/0191992 | A1 | 12/2002 | Funato | |
| 2010/0129107 | A1 | 5/2010 | Takehara et al. | |
| 2012/0063790 | A1 * | 3/2012 | Ogawa | B65H 5/26 399/16 |
| 2014/0029995 | A1 | 1/2014 | Okuda | |
| 2014/0354728 | A1 * | 12/2014 | Murata | B41J 11/002 347/16 |

FOREIGN PATENT DOCUMENTS

| | | | |
|---|---|---|---|
| JP | 2003-66744 A | | 3/2003 |
| JP | 2007079151 A | * | 3/2007 |
| JP | 2009-237514 A | | 10/2009 |
| JP | 2009237514 A | * | 10/2009 |
| JP | 2009265349 A | * | 11/2009 |

* cited by examiner

*Primary Examiner* — Julian Huffman
*Assistant Examiner* — Sharon A Polk
(74) *Attorney, Agent, or Firm* — Birch, Stewart, Kolasch & Birch, LLP

(57) ABSTRACT

An apparatus for cooling media sheets in a printer includes a number of cooling units, a conveyor having a first conveyor path adapted to feed the media sheets successively through the cooling units, and a switch adapted to deflect selected ones of the media sheets into a second conveyor path. The switch is disposed upstream of a last one of the cooling units and downstream of a first one of the cooling units. The second conveyor path bypasses the last one of the cooling units. The conveyor includes a decelerating mechanism configured to decelerate the sheets in the first conveyor path between the first one of the cooling units and the last one of the cooling units.

12 Claims, 1 Drawing Sheet

APPARATUS FOR COOLING MEDIA SHEETS

CROSS-REFERENCE TO RELATED APPLICATIONS

This application claims priority under 35 U.S.C. §119(a) to Application No. 14193048.7 filed in Europe on Nov. 13, 2014, the entire contents of which is hereby incorporated by reference into the present application.

BACKGROUND OF THE PRESENT INVENTION

1. Field of the Invention

The present invention relates to an apparatus for cooling media sheets in a printer, the apparatus comprising: a number of cooling units; a conveyor having a first conveyor path adapted to feed the media sheets successively through the number of cooling units; and a switch adapted to deflect selected ones of the media sheets into a second conveyor path, wherein the switch is disposed upstream of a last one of the number of cooling units and downstream of a first one of the number of cooling units, and the second conveyor path bypasses the last one of the number of cooling units.

2. Description of Background Art

In a printer such as a laser printer or an ink jet printer, the media sheets are frequently subjected to processing steps, e.g. a step of fusing a toner image or a step of drying ink, which results in the sheets being heated to an elevated temperature, so that it is necessary to cool them down again after the print process.

There are several ways to cool the sheets. For example, the sheets may be moved along a cooled stationary part or they may be pressed against a surface of a co-moving member, e.g. a rotating drum having a metal surface with high heat conductivity. The drum may be provided with internal cooling fins or the like for transferring the heat withdrawn from the media sheets onto a cooling medium such as a liquid or ambient air or cooled air. In any case, the necessary measures for cooling the sheets add to the total energy consumption of the printer.

U.S. Application Publication No. 2014/0029995 A1 describes a cooling apparatus in which the sheets are successively passed over peripheral surfaces of two cooling drums.

In some printers, a switch is provided in the conveyor path for diverting selected ones of the media sheets to a different destination. For example, in a duplex printer, some sheets are to be directed to a discharge tray whereas other sheets are to be re-circulated in a duplex path of the printer.

JP 2009-237514 A discloses an apparatus for cooling media sheets in a printer.

SUMMARY OF THE INVENTION

It is an object of the present invention to provide a cooling apparatus, which permits to appropriately cool the sheets with reduced energy consumption, at least under certain operating conditions of the printer.

According to an embodiment of the present invention, in order to achieve this object, the conveyor comprises a decelerating mechanism configured to decelerate the sheets in the first conveyor path between the first one of the cooling units and the last one of the cooling units.

This arrangement permits energy savings when the admissible residual temperature of the sheets depends upon the destination to which the sheets are to be directed. For example, the print process may be such that, in order to obtain a high print quality, the temperature of the sheets at entry into the printing station must not exceed a certain limit. Consequently, in a duplex printer the sheets that have been printed already on one side and have therefore been heated in the print process must be cooled down sufficiently before they are re-circulated for printing on the second side, whereas duplex sheets that have been printed on both sides already or simplex sheets that are to be printed only on one side, anyway, are allowed to have a higher temperature when they are directed to the discharge tray. According to an embodiment of the present invention, the sheets for which a higher exit temperature is admissible will bypass the last cooling unit, whereby the energy consumption of this cooling unit is reduced.

The energy consumption of the last cooling unit may be reduced simply by the fact that only a smaller number of sheets is passed through this unit so that the amount of heat to be removed by this unit is smaller and, consequently, the required amount of cooling air is reduced or the admissible temperature of the cooling air may be higher so that less energy is needed in a refrigerating system for cooling the air.

The media sheets that have left the first cooling unit are decelerated in the first conveyor path, so that more time is available for cooling the sheets to a lower temperature in the last cooling unit. Consequently, the required low temperature for the sheets to be re-circulated can be reached with reduced total heat absorbing capacity of the cooling units, which permits not only to save energy, but also to reduce the space requirement for the cooling units.

More specific optional features of the present invention are indicated in the dependent claims.

In an embodiment of the present invention, the conveyor comprises a decelerating mechanism for decelerating the sheets in the first conveyor path between the first cooling unit and a second cooling unit.

In an embodiment, the first conveyor path includes a duplex path for recirculating sheets from the second cooling unit to an entry side of the printer.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
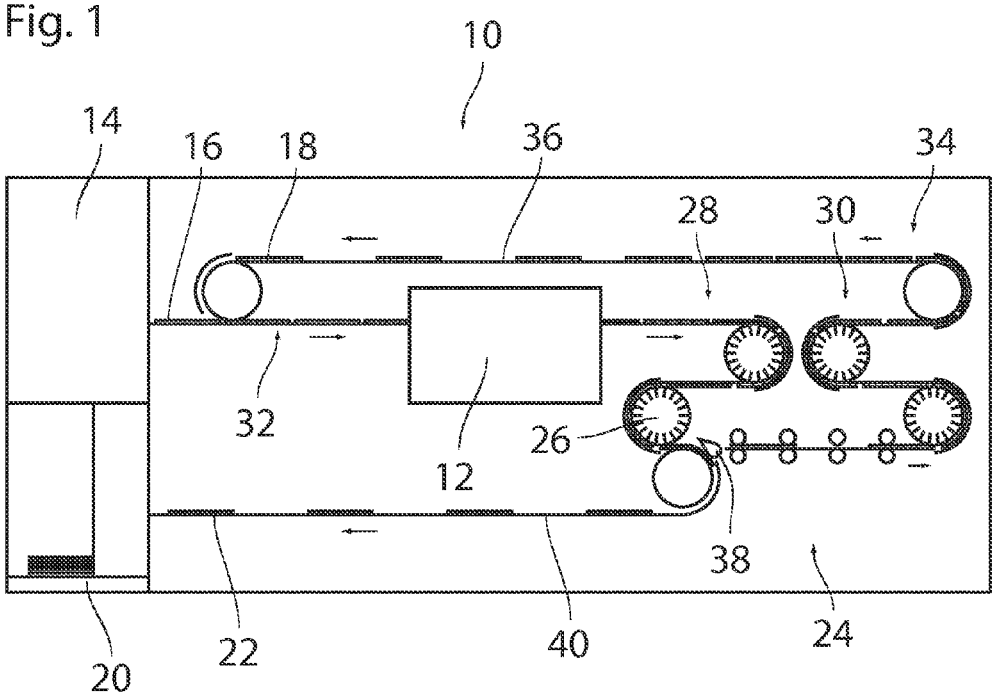
FIG. 1 is a diagram of a printer having a cooling apparatus according to the invention.

The present invention will now be described with reference to the accompanying drawings, wherein the same reference numerals have been used to identify the same or similar elements throughout the several views.

As has been shown schematically in FIG. 1, a printer 10 comprises a printing unit 12, a feeder 14 for feeding media sheets 16, 18 to the printing unit 12, and a discharge tray 20 onto which printed media sheets 22 are discharged.

It shall be assumed here that the printing unit 12 employs a print process, e.g. laser printing or ink jet printing, in which the media sheets are heated to an elevated temperature, so that it is necessary to cool the sheets before they are discharged onto the discharge tray 20. For this reason, a sheet cooling apparatus 24 is provided on the exit side of the printing unit 12. The cooling apparatus 24 comprises a total of four cooling drums 26, two of the cooling drums 26 constitute a first cooling unit 28, while the other two cooling drums 26 constitute a second cooling unit 30. It would also be possible to consider each of the cooling drums 26 as a "cooling unit." However, for the purpose of clarity, it is more convenient here to consider a pair of two cooling drums 26 as a cooling unit 28, 30.

A conveyor 32 is provided for conveying the media sheets 16, 18 from the feeder 14 to the printing unit 12 and further through both cooling units 28, 30 along a first conveyor path 34. The first conveyor path 34 also includes a duplex path 36 along which sheets 18 that have been printed on one side are re-circulated to the entry side of the printing unit 12 for printing an image on the second side.

In the example shown, blank sheets 16 from the feeder 14 and sheets 18 that have been printed on one side (single sided copies) are fed to the printing unit 12 in an interleaved mode, so that the sheets leaving the printing unit 12 form an alternating sequence of single sided copies (sheets 18) and completely printed sheets 22 bearing an image on both sides.

The latter sheets 22 are to be discharged onto the discharge tray 20. To that purpose, a switch 38 is provided for diverting the sheets 22 out of the first conveyor path 34 and into a second conveyor path 40 that leads to the discharge tray 20.

The switch 38 is arranged downstream of the first cooling unit 28 and upstream of the second cooling unit 30, so that the printed (duplex) sheets 22 pass only through the first cooling unit 28, whereas the single sided copies (sheets 18) pass through both cooling units 28 and 30. This permits cooling of the sheets 18 to a lower temperature, which permits a high print quality in the print process in which an image is printed on the second side of the sheets.

Figure 2:
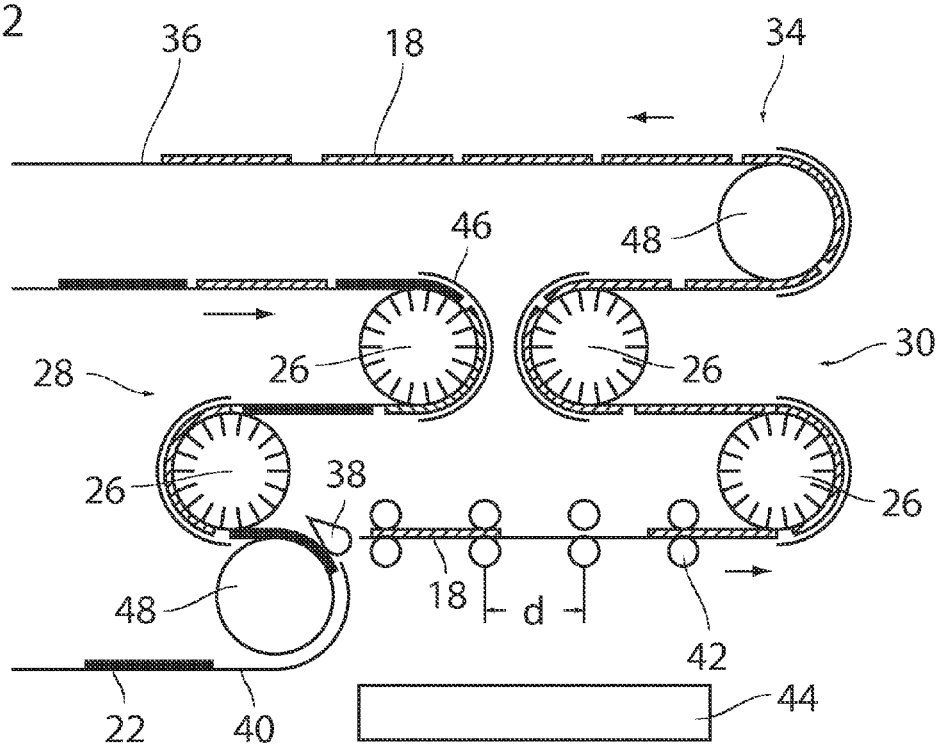
FIG. 2 is an enlarged view of the cooling apparatus.

As can be seen more clearly in FIG. 2, the first conveyor path 34 includes a train of roller pairs 42 that are disposed at regular intervals between the switch 38 and the first cooling drum 26 of the second cooling unit 30. The rollers of each roller pair 42 form a nip for feeding the sheets 18, and at least one roller of each roller pair 42 is actively driven with an individually controllable speed. The distance d between two adjacent roller pairs 42 is smaller than the length of the sheets 18 and is approximately equal to the peripheral length $2\pi r$ of the driven roller (wherein r is the radius of the driven roller).

The sheets 18 and 22 are conveyed from the printing unit 12 to and through the first cooling unit 28 with a given speed, which corresponds to a throughput of 300 sheets per minute, for example. The printed sheets 22 are conveyed with the same speed in the second conveyor path 40. A controller 44, which has only been shown schematically in FIG. 2, controls the driven rollers of the roller pairs 42 such that each sheet 18 leaving the switch 38 on the first conveyor path 34 is decelerated continuously to only half the speed, so that the throughput in the second cooling unit 30 will be only 150 sheets per minute. Consequently, the dwell time of the sheets 18 on the periphery of the cooling drums 26 of the second cooling unit 30 is twice as high as the dwell time in the first cooling unit 28., so that the sheets 18 to be re-circulated to the printing unit 12 can be cooled more intensely.

For a continuous deceleration of the sheets 18. the rollers pairs 42 may for example be controlled as follows. When a sheet leaves the switch 38. the first two rollers pairs 42 are both driven with a speed equal to the speed in the first cooling unit 28. However, as soon as the trailing edge of the sheet has 101 the first roller pair, the second roller pair is decelerated. The third roller pair is driven such that the second and third roller pairs have the same speed when the leading edge of the sheet reaches the third roller pair. The same pattern is used for further decelerating the sheet while passing through the third and fourth roller pairs.

Of course, the deceleration of the sheets 18 has the consequence that the gaps between subsequent sheets 18 become smaller. This is possible, however, because every second sheet 22 is diverted into the second conveyor path 40.

In the example shown, the two pairs of cooling rollers 26 of the two cooling units 28 and 30 are arranged mirror-symmetrically, with the upstream roller 26 of the first cooling unit 28 and the downstream roller 26 of the second cooling unit 30 being disposed close together and at the same height, whereas the downstream cooling roller 26 of the first cooling unit 28 and the upstream cooling roller 26 of the second cooling unit 30 have a larger mutual distance. These two rollers are also disposed at the same height, so that the sheets are deflected by 180° at each cooling roller. This configuration permits a compact construction of the sheet cooling apparatus 24, while leaving a sufficiently long deceleration path for decelerating the sheets between the first and second cooling units 28, 30.

As is well known in the at a guide plate or guide belt 46 (shown only schematically in the drawing) is provided for each of the cooling rollers 26 for pressing the sheets against the peripheral surface of the roller.

As is also well known in the art, the conveyor paths 34 and 40 comprise deflection rollers 48, as well as straight conveyor portions, which may be constituted for example by belts or by trains of roller pairs similar to the roller pairs 42.

Although not shown in detail in the drawings, the straight conveyor portion constituting the duplex loop 36 also includes a train of individually controllable roller pairs similar to the roller pairs 42 for re-accelerating the sheets 18 to their original speed on their way back to the entry side of the printing unit 12. As a consequence, the gaps between the successive sheets 18 increase again, so that it is possible to insert the sheets 18 between the blank sheets 16.

The cooling rollers 26 of the first and second cooling units 28, 30 may have internal cooling fins, and a cooling medium, e.g. air, may be passed through each of these rollers. The flow rate and temperature of the cooling air may be the same for the first and second cooling units, which facilitates the design of the air supply system. Nevertheless, the cooling in the second cooling unit 30 is more efficient due to the large dwell time, It will be understood that the switch 38 must be capable of changing position in the short time interval in which a (narrow) gap between two successive sheets 18, 22 passes the switch. The switching time of the switch 38 may therefore be as small as 30 ms or even less.

Of course, the printer may also be operated in a simplex mode, in which the switch 38 has a constant position and all sheets are directed towards the discharge tray 20 after having passed the printing unit 12 only once.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus for cooling media sheets in a printer, the apparatus comprising:

a number of cooling units;

a conveyor having a first conveyor path adapted to feed the media sheets successively through the number of cooling units; and a switch adapted to deflect selected ones of the media sheets into a second conveyor path, wherein the switch is disposed upstream of a last one of the number of cooling units and downstream of a first one of the number of cooling units, and the second conveyor path bypasses the last one of the number of cooling units, and wherein the conveyor further comprises a decelerating mechanism configured to decelerate the media sheets in the first conveyor path positioned between the first one of the number of cooling units and the last one of the number of cooling units and downstream of the switch.

2. The apparatus according to claim 1, wherein the decelerating mechanism is constituted by a train of individually controllable roller pairs, the rollers of each roller pair forming a nip for the media sheets to be decelerated.

3. The apparatus according to claim 2, wherein the train of individually controllable roller pairs is controlled to:

when a sheet leaves the switch, drive both of a first two roller pairs with a speed equal to a speed in the first cooling unit;

as soon as the trailing edge of the sheet has left the first roller pair, decelerate a second roller pair; and drive a third roller pair such that the second and third roller pairs have the same speed when the leading edge of the sheet reaches the third roller pair.

4. The apparatus according to claim 1, wherein the cooling units upstream and downstream of the switch have identical cooling capacities.

5. A printer, comprising:

a printing unit; and the cooling apparatus according to claim 1, wherein the first conveyor path includes a duplex path for recirculating media sheets from the last one of the number of cooling units to an entry side of the printing unit.

6. The printer according to claim 5, wherein the duplex path includes a re-accelerating mechanism for re-accelerating the sheets to their original speed on their way back to the entry side of the printing unit.

7. The apparatus according to claim 1, wherein the decelerating mechanism is arranged for decelerating the sheets, such that gaps between subsequent sheets become smaller.

8. The apparatus according to claim 1, wherein the conveyer further comprises a re-accelerating mechanism for re-accelerating the sheets, which re-accelerating mechanism is positioned downstream of the last one of the cooling units.

9. The apparatus according to claim 8, wherein the re-accelerating mechanism comprises a train of individually controllable roller pairs.

10. The apparatus according to claim 1, wherein the second conveyer path leads to a discharge tray.

11. The apparatus according to claim 1, wherein, when sheets are conveyed from the printing unit to and through the first cooling unit with a given speed, the decelerating mechanism is arranged for decelerating the sheets, such that a sheet on the first conveyor path is decelerated to only half said speed.

12. The apparatus according to claim 11, wherein sheets are conveyed with said speed in the second conveyor path.

* * * * *